US012799890B2

(12) United States Patent
Shamim et al.

(10) Patent No.: US 12,799,890 B2
(45) Date of Patent: Nov. 17, 2026

(54) DEGASSING DEVICE FOR A ROAD VEHICLE

(71) Applicant: Volvo Truck Corporation, Gothenburg (SE)

(72) Inventors: Mohammad Zohaib Shamim, Patna (IN); Shital Dubey, Bengaluru (IN); Bhargav Varanasi, Bangalore (IN)

(73) Assignee: Volvo Truck Corporation, Gothenburg (SE)

( * ) Notice: Subject to any disclaimer, the term of this patent is extended or adjusted under 35 U.S.C. 154(b) by 0 days.

(21) Appl. No.: 19/274,855

(22) Filed: Jul. 21, 2025

(65) Prior Publication Data

US 2026/0036075 A1 Feb. 5, 2026

(30) Foreign Application Priority Data

Jul. 31, 2024 (EP) ..... 24192136

(51) Int. Cl.
*F01P 3/22* (2006.01)
*F01P 11/02* (2006.01)

(52) U.S. Cl.
CPC ..... *F01P 11/0285* (2013.01)

(58) Field of Classification Search
CPC .... F01P 11/028; F01P 11/029; F01P 11/0285; F01P 11/02; B01D 19/0057
USPC ..... 123/41.54
See application file for complete search history.

(56) References Cited

U.S. PATENT DOCUMENTS 8,251,024 B2 * 8/2012 Hutchins ..... F01P 11/029 220/746
10,989,102 B2 * 4/2021 Han ..... F01P 11/028
11,713,708 B2 8/2023 Petschenyk
11,905,982 B2 * 2/2024 Barbolini ..... B60H 1/00571
12,304,273 B2 * 5/2025 Lin ..... B01D 19/0042
2008/0179227 A1 * 7/2008 Saito ..... B01D 19/0057 210/512.1

(Continued)

FOREIGN PATENT DOCUMENTS

DE 69617066 T2 8/2002
EP 1505273 A2 2/2005

(Continued)

OTHER PUBLICATIONS

European Search Report for European Patent Application No. 24192136.0, completed Dec. 18, 2024, 2 pages.

*Primary Examiner* — Logan M Kraft
*Assistant Examiner* — James J Kim
(74) *Attorney, Agent, or Firm* — Withrow & Terranova, PLLC

(57) ABSTRACT

A degassing device, comprising a degassing tank comprising a bypass, a labyrinth, a degassed coolant outlet and a separator compartment, for extracting a primary degassed coolant flow, led to the bypass, and a residual coolant flow, led to the labyrinth, by centrifugation of an engassed coolant flow; wherein a secondary degassed coolant flow is extracted from the residual coolant flow by flowing of the residual coolant flow through the labyrinth; wherein the primary degassed coolant flow flows from the bypass to the degassed coolant outlet, without flowing through the labyrinth; wherein the secondary degassed coolant flow flows from the labyrinth to the degassed coolant outlet, without flowing through the bypass.

15 Claims, 4 Drawing Sheets

(56) References Cited

U.S. PATENT DOCUMENTS

| | | | | |
|---|---|---|---|---|
| 2011/0061613 | A1 | 3/2011 | Hutchins | |
| 2016/0208678 | A1* | 7/2016 | Zhang | F16N 19/00 |
| 2022/0333623 | A1 | 10/2022 | Barbolini et al. | |

FOREIGN PATENT DOCUMENTS

| | | | |
|---|---|---|---|
| EP | 3012429 | A1 | 4/2016 |
| GB | 2582543 | A | 9/2020 |
| GB | 2598507 | A | 3/2022 |

* cited by examiner

DEGASSING DEVICE FOR A ROAD VEHICLE

PRIORITY APPLICATIONS

The present application claims priority to European Patent Application No. 24192136.0, filed on Jul. 31, 2024, and entitled "DEGASSING DEVICE FOR A ROAD VEHICLE," which is incorporated herein by reference in its entirety.

TECHNICAL FIELD

The disclosure relates generally to a degassing of coolant in road vehicles. In particular aspects, the disclosure relates to a degassing device for degassing a coolant flow and a road vehicle comprising said degassing device. The disclosure can be applied to heavy-duty vehicles, such as trucks, buses, and construction equipment, among other vehicle types. Although the disclosure may be described with respect to a particular vehicle, the disclosure is not restricted to any particular vehicle.

BACKGROUND

A known expansion tank consists of numerous baffles through which coolant must travel to eliminate air contained in the coolant. The longer the coolant remains in the tank, following its convoluted path, the higher the probability of air separation from the coolant. Thus, the known expansion tanks are often bulky, in particular in large vehicles such as trucks, buses and construction equipment.

SUMMARY

According to a first aspect of the disclosure, the invention relates to a degassing device, for degassing an engassed coolant flow, the degassing device comprising a degassing tank comprising:

- a separator compartment, configured for extracting a primary degassed coolant flow and a residual coolant flow from the engassed coolant flow by a centrifugation of the engassed coolant flow inside the separator compartment;
- a degassed coolant outlet;
- a bypass, bordering with the separator compartment, wherein the separator compartment leads to the bypass so that the primary degassed coolant flow flows from the separator compartment to the bypass; and
- a labyrinth, bordering with the separator compartment, wherein the separator compartment leads to the labyrinth so that the residual coolant flow flows from the separator compartment to the labyrinth, wherein the labyrinth is configured so that a secondary degassed coolant flow is extracted from the residual coolant flow by flowing of the residual coolant flow through the labyrinth;

wherein the bypass leads to the degassed coolant outlet, so that the primary degassed coolant flow flows from the bypass to the degassed coolant outlet, without flowing through the labyrinth; wherein the labyrinth leads to the degassed coolant outlet, so that the secondary degassed coolant flow flows from the labyrinth to the degassed coolant outlet, without flowing through the bypass.

The first aspect of the disclosure may seek to reduce the overall bulk of the degassing device and making it more efficient, in particular for large vehicles such as trucks, buses and construction equipment. By centrifugating the separator compartment within the degassing tank, the need for the engassed coolant to flow through a convoluted path for removing gas, usually air, from the engassed coolant and obtaining the degassed coolant, is reduced. Preferably, the separator compartment is designed so that the incoming coolant flow traces a helical trajectory due to the shape of the separator compartment, thereby submitting the engassed coolant flow to centrifugal forces, i.e. the centrifugation. Due to the disparity in density between the coolant and the gas contained therein, the gas separates and tends to accumulate at a center of the helical trajectory, while the coolant tends to remain at a periphery of the helical trajectory. At the periphery, the primary degassed coolant flow is obtained and is retrieved, formed by coolant with a very small fraction of gas, or no gas at all. At the center, the residual coolant flow is obtained and can be retrieved. The residual coolant flow includes mostly gas and a small fraction of coolant, which is easily separated through the labyrinth. Overall, the degassing device enables that the coolant flows along a shorter path than in the prior art. Therefore, thanks to the separator compartment, a less bulky degassing device is obtained overall, since the size of the labyrinth can be kept relatively small. Moreover, incorporating the centrifugation within the tank itself and driving the primary coolant flow towards the degassed coolant outlet by the bypass integrated to the tank itself, also enables that degassing device is less bulky and more efficient than in the prior art. In some applications, the degassing device may lead to a reduction of the size of the degassing device of approximately 20%, since only a small portion of the engassed coolant needs to follow the intricate path of the labyrinth, with most of the coolant already being degassed by centrifugation in the separator compartment.

Since the labyrinth can be smaller than in the prior art, the degassing process is less affected than in the prior art when the vehicle is positioned on a slope. Therefore, the degassing device can be useful in particular for off-road vehicles or military vehicles, where the required angle of inclination can be as high as thirty degrees.

Advantageously, this degassing device also enables a reduction in the time it takes for the coolant to be degassed, compared to the prior art, resulting in a decrease in pressure drop and thus reducing the power required by a coolant pump to circulate the coolant flow. This may in turn enable fuel economy and overall operational efficiency.

In case the gas contained in the coolant is air, "degassing" is synonymous to "deaerating", "engassed" is synonymous to "aerated" and "degassed" is synonymous to "deaerated".

Optionally in some examples, including in at least one preferred example, the degassing tank comprises an outlet compartment, bordering with the bypass and with the labyrinth and leading to the degassed coolant outlet; the bypass leads to the degassed coolant outlet by leading to the outlet compartment; and the labyrinth leads to the degassed coolant outlet by leading to the outlet compartment. A technical benefit may include efficiently merging the primary and secondary coolant flow before they reach the degassed coolant outlet, with limited bulk for the degassing tank.

Optionally in some examples, including in at least one preferred example, the degassing device further comprises at least one centrifugation cavity arranged inside the separator compartment, enabling the centrifugation of the engassed coolant flow for extracting the primary degassed coolant flow and the residual coolant flow inside said at least one centrifugation cavity. A technical benefit may include obtaining centrifugation of the engassed coolant flow without the need of an additional pump or actuator, as the shape of the centrifugation cavity forces the engassed coolant flow to a helical trajectory inside the centrifugation cavity.

Optionally in some examples, including in at least one preferred example, the degassing device further comprises at least one inlet port, opening outside of the degassing tank and leading to said at least one centrifugation cavity, for flowing of the engassed coolant flow from outside of the degassing tank to said at least one centrifugation cavity. A technical benefit may include that the degassing device can easily be installed in a vehicle as a replacement or retrofit of a previous degassing tank.

Optionally in some examples, including in at least one preferred example, said at least one centrifugation cavity has a geometry of revolution about a central axis. A technical benefit may include efficiently obtaining centrifugation of the engassed coolant flow.

Optionally in some examples, including in at least one preferred example, the separator compartment, the bypass, the labyrinth and said at least one centrifugation cavity are crossed by a main plane of the degassing tank. A technical benefit may include obtaining a degassing device that is of a similar shape than prior-art degassing tanks which are devoid of centrifugation, enabling easy replacement of a prior-art tank with the present degassing device, which includes embedded centrifugation of the engassed coolant flow with the aforementioned advantages.

Optionally in some examples, including in at least one preferred example, the central axis is perpendicular or oblique relative to the main plane. A technical benefit may include obtaining an especially compact configuration of the degassing device, while the degassing is efficient.

Optionally in some examples, including in at least one preferred example, said at least one inlet port is connected to said at least one centrifugation cavity tangentially to a peripheral wall of the centrifugation cavity and orthogonally to the central axis, so that the centrifugation is induced by flowing of the engassed coolant flow from said at least one inlet port to said at least one centrifugation cavity. A technical benefit may include obtaining a strong and efficient centrifugation of the engassed coolant flow.

Optionally in some examples, including in at least one preferred example, the degassing device further comprises at least one first outlet port opening inside said at least one centrifugation cavity and leading to the bypass, for the primary degassed coolant flow to flow from said at least one centrifugation cavity to the bypass; and at least one second outlet port opening inside said at least one centrifugation cavity and leading to the labyrinth, for the residual coolant flow to flow from said at least one centrifugation cavity to the labyrinth. A technical benefit may include that the degassing device is overall compact while embedding the centrifugation in the degassing tank.

Optionally in some examples, including in at least one preferred example, in said at least one centrifugation cavity, said at least one inlet port is arranged between said at least one first outlet port and said at least one second outlet port. A technical benefit may include efficient separation of the primary degassed coolant flow from the residual coolant flow, while the degassing device is overall compact.

Optionally in some examples, including in at least one preferred example, the labyrinth includes a series of successive labyrinth compartments, including a first labyrinth compartment and a last labyrinth compartment; each labyrinth compartment, except for the last labyrinth compartment, leads to a single other of the labyrinth compartments, so that the residual coolant flow and the secondary degassed coolant flow flow successively through each labyrinth compartment, from the first labyrinth compartment to the last labyrinth compartment; the separator compartment leads to the first labyrinth compartment, so that the residual coolant flow flows from the separator compartment to the first labyrinth compartment; and the last labyrinth compartment leads to the degassed coolant outlet so that the secondary degassed coolant flow flows from the last labyrinth compartment to the degassed coolant outlet. A technical benefit may include efficient extraction of the secondary coolant flow.

Optionally in some examples, including in at least one preferred example, the bypass forms a single non-partitioned compartment of the degassing tank. A technical benefit may include leading the primary degassed coolant flow to the degassed coolant outlet with reduced pressure drop, while the degassing device remains compact and while the mixing of the primary and secondary coolant flow occurs only at the degassed coolant outlet.

Optionally in some examples, including in at least one preferred example, the bypass is surrounded by the separator compartment, the labyrinth and the degassed coolant outlet. A technical benefit may include that the degassing device is especially compact, in particular if the bypass, the labyrinth and the separator compartment are crossed by a main plane of the degassing tank.

According to a second aspect of the disclosure, the invention relates to a road vehicle, comprising the degassing device as disclosed here-above. The second aspect of the disclosure may seek to reduce the overall bulk of the degassing device and making it more efficient, in particular for large vehicles such as trucks, buses and construction equipment.

Optionally in some examples, including in at least one preferred example, the separator compartment, the bypass and the labyrinth are crossed by a main plane of the degassing tank, and the main plane is oriented parallel to a ground surface when said road vehicle rests on said ground surface. A technical benefit may include obtaining that the degassing device, more efficient thanks to the centrifugation, may have a shape similar than that of a prior art degassing tank devoid of centrifugation.

The disclosed aspects, examples (including any preferred examples), and/or accompanying claims may be suitably combined with each other as would be apparent to anyone of ordinary skill in the art. Additional features and advantages are disclosed in the following description, claims, and drawings, and in part will be readily apparent therefrom to those skilled in the art or recognized by practicing the disclosure as described herein.

BRIEF DESCRIPTION OF THE DRAWINGS

Examples are described in more detail below with reference to the appended drawings.

DETAILED DESCRIPTION

The detailed description set forth below provides information and examples of the disclosed technology with sufficient detail to enable those skilled in the art to practice the disclosure.

Figure 1:
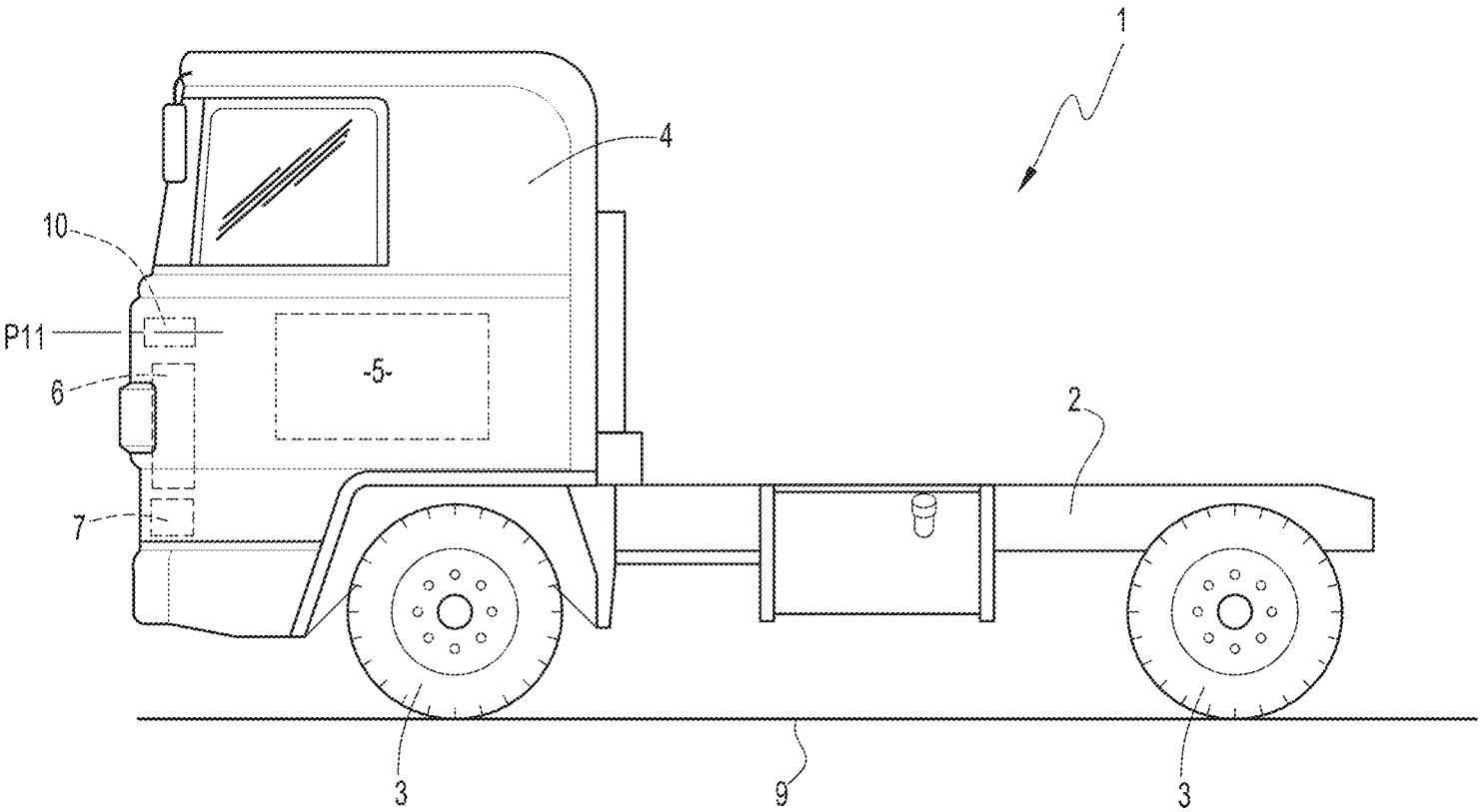
FIG. 1 is a side view of a road vehicle, including a degassing device according to an example.

FIG. 1 shows a road vehicle 1, in the form of a truck. The road vehicle 1 comprises a chassis 2 with wheels 3 intended to rest on a ground surface 9, a driver's cab 4 and a motor 5 for driving the wheels 3 in rotation, so that the vehicle 1 moves forward or backwards. The motor 5 is attached to the chassis and enclosed under the driver's cab 4. The motor is preferably an internal combustion engine, but could be a combined internal combustion engine and electric motor, or an electric motor without combustion engine. The motor 5 needs to be cooled when in use. Therefore the vehicle 1 includes a cooling circuit, with a cooling package 6, a coolant pump 7 and a degassing device 10. The coolant pump 7 circulates said coolant flow along the cooling circuit in a closed loop, successively through the cooling package 6, the motor and the degassing device 10.

The cooling package 6 cools the coolant of the cooling circuit as it was heated by the motor 5 for cooling the motor 5. To that end, the cooling package 6 enables a heat exchange with outside air at the front of the vehicle 1. The cooling package 6 is therefore placed at the front of the vehicle 1, and may be located under the driver's cab 4, as illustrated.

The degassing device 10 enables degassing the coolant flow, which was engassed during its flowing though the cooling circuit. In other words, the degassing device 10 turns the engassed coolant flow into a degassed coolant flow. The degassing device 10 may, for example, be positioned between the driver's cab 4 and the cooling package 6.

The coolant may for example includes liquid water and glycol. The gas engassing the coolant flow may be air.

Figure 2:
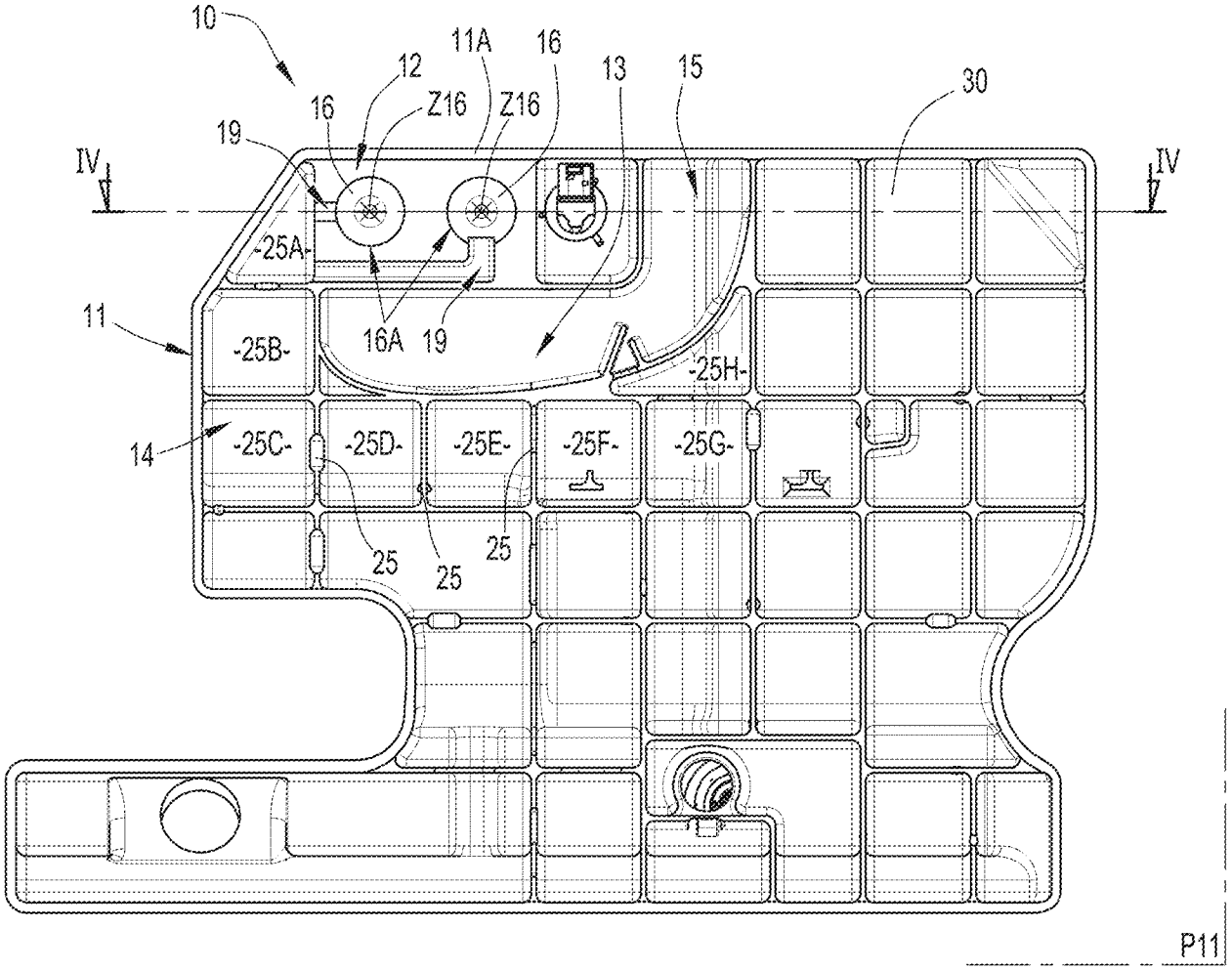
FIG. 2 is a bottom cross-section of the degassing device of FIG. 1.
Figure 3:
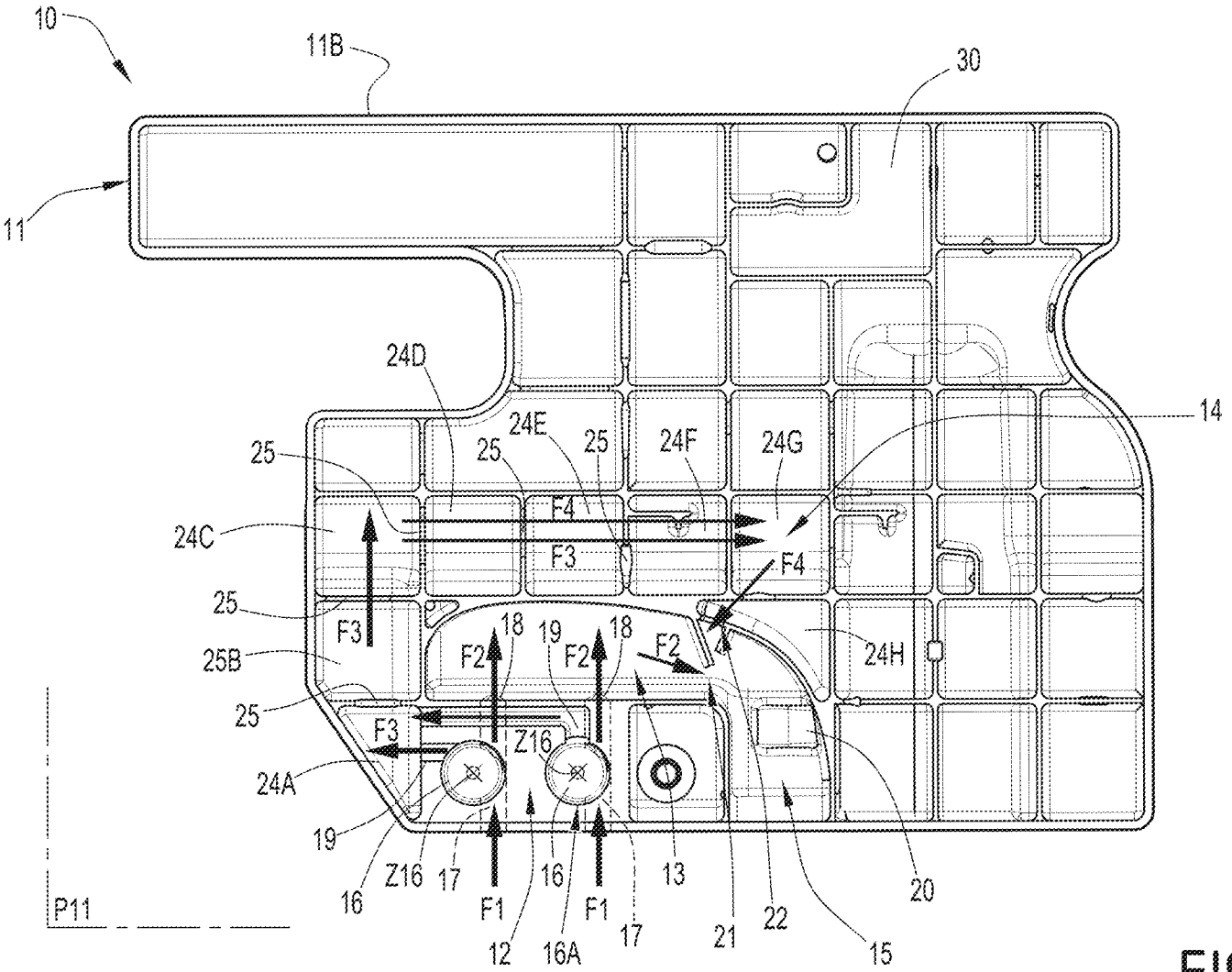
FIG. 3 is a top cross-section of the degassing device of FIGS. 1 and 2.
Figure 4:
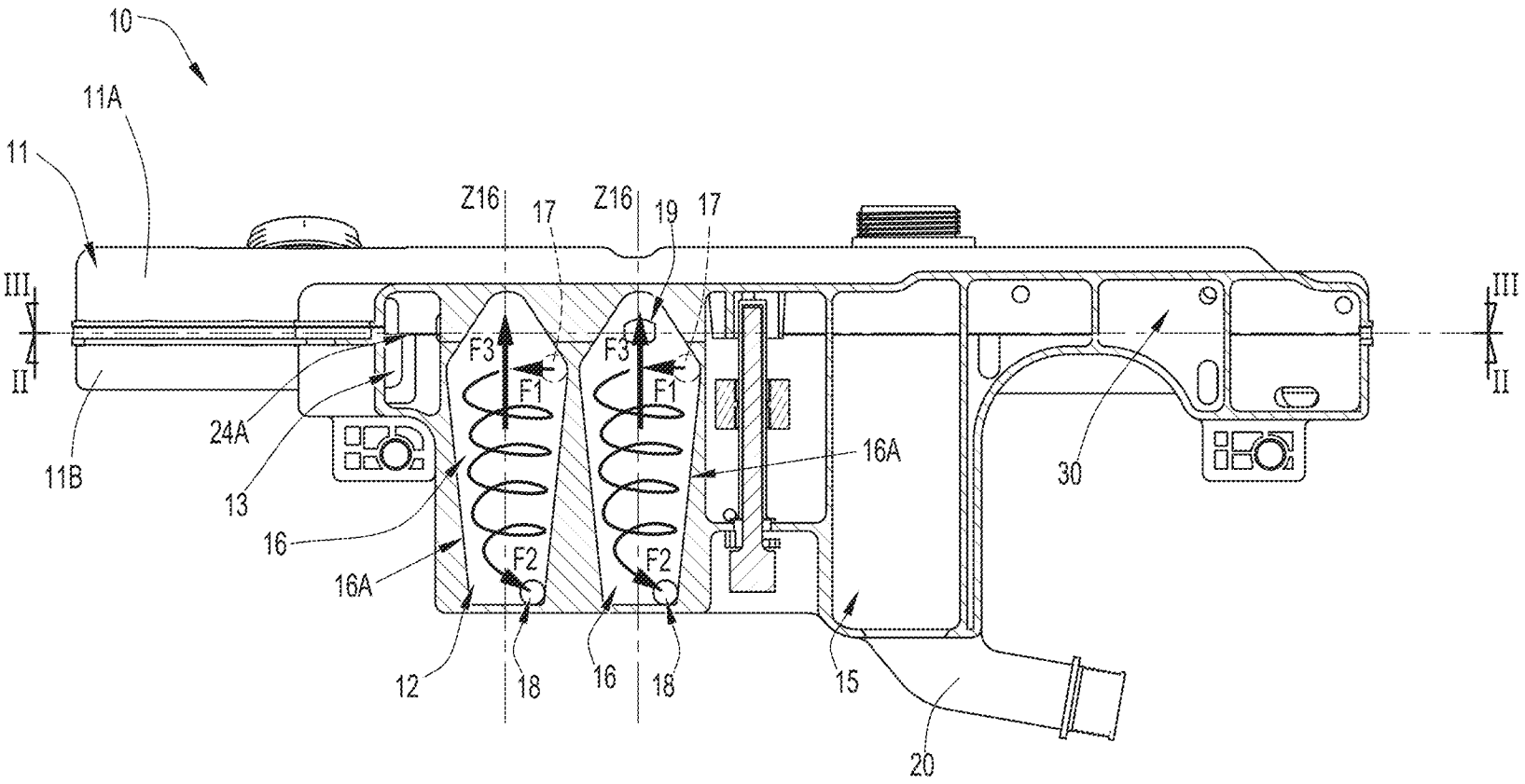
FIG. 4 is a side cross section of FIG. 2 along plane IV-IV shown in FIG. 2, FIG. 4 also showing a plane II-II along which the cross-section of FIG. 2 was taken and a plane III-III along which the cross-section of FIG. 3 was taken.

The degassing device 10 is shown in detail in FIGS. 2-4. The degassing device 10 essentially comprises a degassing tank 11, extending along a main plane P11, said plane P11 being shown also in FIG. 1. As shown in FIG. 1, the main plane P11 is preferably oriented parallel to the horizontal ground surface 9 vehicle 1 rests upon.

The degassing tank 11 comprises a separator compartment 12, a bypass 13, a labyrinth 14 and an outlet compartment 15. The separator compartment 12, the bypass 13, the labyrinth 14 and outlet compartment 15 are bordering with each other, except for the separator compartment 12 which may not border with the outlet compartment 15. The separator compartment 12, the bypass 13, the labyrinth 14 and outlet compartment 15 belong to the same tank 11, i.e. the same enclosure. Preferably, they are all crossed by the main plane P11. The degassing tank 11 preferably comprises a single-piece upper shell 11A shown in FIG. 2 and a single-piece lower shell 11B shown in FIG. 3, assembled together at the main plane P11 as shown in FIG. 4, each shell 11A and 11B forming a respective portion of the separator compartment 12, bypass 13, labyrinth 14 and outlet compartment 15.

Preferably, along the plane 11, the bypass 13 is surrounded by the separator compartment 12, the labyrinth 14 and the outlet compartment 15. In other words, along the plane P11, the bypass is preferably inside the tank 11 and is not bordering with an outside periphery of the tank 11. In contrast, each of the separator compartment 12, the labyrinth 14 and the outlet compartment 15 are preferably bordering with the outside periphery of the tank 11.

Preferably, the compartment 12 is bordering with the labyrinth 14. Between the labyrinth 14 and the outlet compartment 15, the compartment 12 is bordering with the bypass 13. The bypass 13 extends along the compartment 12 from the labyrinth 14 to the outlet compartment 15. Extending away from the bypass 13, the outlet compartment 15 is bordering with to the outside periphery of the tank 11.

The separator compartment 12 is configured for receiving the engassed coolant flow F1 coming from the motor 5, and for extracting a primary degassed coolant flow F2 and a residual coolant flow F3 from the engassed coolant flow F1.

To this end, the degassing device 10 comprises several centrifugation cavities 16, here two centrifugation cavities 16. Each cavity 16 is arranged inside the separator compartment 12, and is preferably crossed by the main plane P11. Each cavity 16 can be formed integrally by the shells 11A and 11B as illustrated, each shell 11A and 11B forming a respective part of the cavity 16. Alternatively, the cavities 16 can be formed in only one of the shells 11A or 11B or by a device initially separate from the tank 11 and added into the compartment 12, assembled with the tank 11. The cavities 16 are preferably arranged side by side along the plane P11.

Each cavity 16 has a geometry of revolution about a respective central axis Z16, e.g. an overall cylindrical or conical shape about the axis Z16, with a peripheral wall 16A of the cavity 16 centered on the axis Z16. As best visible in FIG. 4, the exemplary cavities 16 may each have a bottom part, where the peripheral wall 16A is of frustoconical shape and a top part where the peripheral wall 16A is dome-shaped. The bottom part is preferably formed by the shell 11B while the top part is at least in part formed by the shell 11A, as shown in FIG. 4. The axes Z16 are parallel to each other and preferably perpendicular to the plane P11, i.e. are perpendicular to the ground surface 9 when the vehicle 1 rests on the ground surface. Instead the axes Z16 can be chosen slightly oblique relative to the plane P11, although preferably parallel to each other.

Respectively for each cavity 16, the degassing device 10 further comprises inlet ports 17. Each inlet port 17 opens outside of the degassing tank 11, at a location preferably close to, or bordering with, the separation compartment 12. There, each inlet port 17 may be connected to a part of the cooling circuit output from the motor 5, for example via appropriate ducts and couplings. To that end, the separation compartment 12 preferably borders with the outside of the tank 11. Each inlet port 17 leads into the degassing tank 11, to one of the cavities 16, i.e. connects the outside of the degassing tank 11 to the inside of the cavity 16. Thus, the engassed coolant flow F1 flows from outside of the degassing tank 11 to the cavities 16 via the inlet ports 17. The inlet ports 17 may be formed integrally with the tank 11 as illustrated, for example formed by the shell 11B, or be formed by a separate piece added to the tank 11.

Alternatively, a single inlet port 17 may lead to all cavities 16 or to several cavities 16.

As shown in FIGS. 3 and 4, each inlet port 17 is connected to the centrifugation cavity 16 tangentially to the peripheral wall 16A of the cavity 16 and orthogonally to the central axis Z16, so as to impart a centrifugation movement to the flow F1 around the axis Z16 as the flow F1 enters the cavity via the port 17. In FIG. 4, the inlet port 17 is shown in dashed lines since the inlet port 17 is positioned behind the sectional plane and would not normally be visible. In other words, the centrifugation is induced by flowing of the engassed coolant flow F1 from the inlet port 17 to the centrifugation cavity 16, thanks to the dynamic pressure of the flow F1 and the shape of the port 17 and the cavity 16. "Tangential" preferably means that the inlet port 17 is parallel to the peripheral wall 16A of the cavity 16 and oriented parallel to a plane that is perpendicular to the axis Z16 and parallel to said peripheral wall 16A. In the cavity 16, the flow F1 spirals around the axis Z16 and along the peripheral wall 16A, away from the port 17, i.e. downwards in the present example.

The separator compartment 12 achieves the extraction of the primary degassed coolant flow F2 and of the residual coolant flow F3 by this centrifugation of the flow F1 imparted inside the cavities 16. As schematically illustrated in FIG. 4, the centrifugal forces applied to the flow F1 by the centrifugation of the flow F1 tend to lead the coolant away from the axis Z16, along the peripheral wall 16A of the cavity 16, thereby forming the degassed coolant flow F2, while the gas contained in the flow F1 is concentrated at the axis Z16, at the center of the cavity 16, close to the axis Z16, and forms the residual flow F3. The heavier flow F2 tends to flow downwards due to gravity, while the lighter flow F3 tends to bubble upwards.

The separator compartment 12 leads to the bypass 13 so that the primary degassed coolant flow F2 flows from the compartment 12 to the bypass 13, without flowing through the labyrinth 14. To that end, respectively for each cavity 16, the degassing device 10 preferably comprises outlet ports 18. Each outlet port 18 opens inside one of the cavities 16 and leads to the bypass 13, for the primary degassed coolant flow F2 to flow from the cavity 16 to the bypass 13.

As shown in FIGS. 3 and 4, each outlet port 18 is connected to the centrifugation cavity 16 tangentially to the peripheral wall 16A of the cavity 16 and orthogonally to the central axis Z16, so as to best retrieve the flow F2 concentrated at the peripheral wall 16A of the cavity 16. Preferably, the outlet port 18 is formed at an end of the cavity 16 along the axis Z16, preferably a bottom end. Preferably the outlet port 18 is integrally formed by the tank 11, in particular the shell 11B. Preferably, the inlet port 17 is formed between the plane P11 and the outlet 18.

Preferably, the bypass 13 forms a single non-partitioned compartment of the degassing tank 11, bordering with, and extending along, the compartment 12. The bypass 13 leads to the outlet compartment 15, so that the primary degassed coolant flow F2 flows from the bypass 13 to the outlet compartment 15, without flowing through the labyrinth 14. To that end, an opening 21 may be provided in a wall of the tank separating the bypass 13 and the outlet compartment 15, for connecting the bypass 13 and the compartment 15. The flow F2 reaches the compartment 15 from the bypass 13 through said opening 21.

The tank 11 comprises a degassed coolant outlet 20, branching from the outlet compartment 15, i.e. connecting the outlet compartment 15 to an outside of the tank 11. In other words, the outlet compartment 15 leads to the outlet 20. The degassed coolant outlet 20 may be connected to a part of the cooling circuit input to the cooling package 6, for example via appropriate ducts and couplings. To that end, the degassed coolant outlet 20 preferably branches from a bottom of the compartment 15. The degassed coolant outlet 20 is preferably formed by the shell 11B.

Therefore, the degassed flow F2 received from the bypass 13 into the outlet compartment 15 is discharged from the tank 11 via the outlet 20. In other words, the bypass 13 leads to the degassed coolant outlet 20 by leading to the outlet compartment 15, so that the primary degassed coolant flow F2 flows from the bypass 13 to the degassed coolant outlet 20, without flowing through the labyrinth 14.

The separator compartment 12 leads to the labyrinth 14 so that the residual coolant flow F3 flows from the separator compartment 12 to the labyrinth 14 without flowing through the bypass 13. To that end, respectively for each cavity 16, the degassing device 10 preferably comprises outlet ports 19. Each outlet port 19 opens inside one of the cavities 16 and leads to the labyrinth 14, for the residual coolant flow F3 to flow from the cavity 16 to the labyrinth 14.

As shown in FIGS. 3 and 4, each outlet port 19 is connected to the centrifugation cavity 16 at an end of the cavity 16 opposite to the outlet port 18 along axis Z16, so as to best retrieve the flow F3 bubbling along the axis Z16 in a direction opposite to the flow F2. Preferably, the outlet port 18 is connected to the cavity 16 at an upper end thereof. Preferably, for each cavity 16, the connection of the inlet port 17 with the cavity 16 is arranged between the connection of the outlet port 18 with the cavity 16 and the connection of the outlet port 19 with the cavity 16.

Preferably the outlet port 19 is integrally formed by the tank 11, in particular by the shell 11B, or by both shells 11A and 11B, as best visible in FIG. 4 for one of the cavities 16.

The labyrinth 14 is configured so that a secondary degassed coolant flow F4 is extracted from the residual coolant flow F3 by flowing of the residual coolant flow F3 through the labyrinth 14. To that end, the labyrinth 14 forms a tortuous path for the residual coolant flow F3. In particular, to that end, the labyrinth 14 includes a series of successive labyrinth compartments 24. Here the compartments 24 include a first compartment 24A and a last compartment 24H, and intermediate compartments 24B, 24C, 24D, 24E, 24F, 24G. Preferably, each compartment 24 is crossed by the main plane P11. The outlet ports 19 of the separator compartment 12 lead to the first labyrinth compartment 24A, so that the residual coolant flow F3 flows from the separator compartment 12 to the first labyrinth compartment 24A. Each labyrinth compartment 24A, 24B, 24C, 24D, 24E, 24F, 24G, i.e. except for the last labyrinth compartment 24H, leads to a single other of the labyrinth compartments 24A-24G, so that the residual coolant flow F3 and the secondary degassed coolant flow F4 flow successively through each labyrinth compartment 24A to 24H, from the first labyrinth 24A compartment to the last labyrinth compartment 24H. For example the compartment 24C leads to the compartment 24D.

Each compartment 24 is preferably bordering with the subsequent compartment 24 it leads to, and is separate therefrom by a wall. Each compartment 24 leads to the subsequent compartment 24 by an opening 25 formed in said wall separating the two. From one compartment 24 to the next, each opening 25 may be arranged in the shell 11A or the shell 11B or both, for obtaining tortuous flowing of the flows F3 and F4.

In use, the flow of degassed coolant F4 is formed at the bottom of the labyrinth 14, i.e. under plane P11, while the extracted gas gathers at the top of the labyrinth 14, i.e at least in part over plane P11.

Preferably, the compartments 24B, 24C, 24D, 24E, 24F and 24G are bordering with the bypass 13, which enables a very compact distribution of the labyrinth 14.

The labyrinth 14 leads to the outlet compartment 15, so that the secondary degassed coolant flow F4 flows from the labyrinth 14 to the outlet compartment 15, without flowing through the bypass 13. To that end, an opening 22 may be provided in a wall of the tank 11 separating the labyrinth 14 and the outlet compartment 15, for connecting the bypass 13 and the compartment 15. The flow F4 reaches the compartment 15 from the labyrinth 14 through said opening 22. In particular, the last labyrinth compartment 24H is bordering with the outlet compartment 15 and leads to the outlet compartment 15 for leading to the degassed coolant outlet 20, so that the secondary degassed coolant flow F4 flows from the last labyrinth compartment 24D to the degassed coolant outlet 20 via the compartment 15, the opening 22 connecting the compartment 24H to the compartment 15.

The degassed flow F4 received from the labyrinth 14 into the outlet compartment 15 is discharged from the tank 11 via the outlet 20. In other words, the labyrinth 14 leads to the degassed coolant outlet 20 by leading to the outlet compartment 15, so that the secondary degassed coolant flow F4 flows from the labyrinth 14 to the degassed coolant outlet 20, without flowing through the bypass 13.

The tank 11 may include a secondary labyrinth 30 for storing gas extracted from the engassed coolant flow F1. As the coolant heats up, it expands. The space in the secondary labyrinth 30, or in the tank 11 overall, allows for this expansion by providing a cushion of gas or air that can compress, thereby preventing excessive pressure build-up within the cooling circuit. The secondary labyrinth 30 is connected to the labyrinth 14, e.g. by being connected to some of the compartments 24, without being connected to the compartments 12 and 15 or to the bypass 13. The secondary labyrinth 30 may be formed by several additional compartments similar to the compartments 24, connected to each other. Preferably, the secondary labyrinth 30 and each compartment thereof are crossed by the main plane P11.

Example 1: A degassing device 10, for degassing an engassed coolant flow F1, the degassing device 10 comprising a degassing tank 11 comprising:

- a separator compartment 12, configured for extracting a primary degassed coolant flow F2 and a residual coolant flow F3 from the engassed coolant flow F1 by a centrifugation of the engassed coolant flow F1 inside the separator compartment 12;
- a degassed coolant outlet 20;
- a bypass 13, bordering with the separator compartment 12, wherein the separator compartment 12 leads to the bypass 13 so that the primary degassed coolant flow F2 flows from the separator compartment 12 to the bypass 13; and
- a labyrinth 14, bordering with the separator compartment 12, wherein the separator compartment 12 leads to the labyrinth 14 so that the residual coolant flow F3 flows from the separator compartment 12 to the labyrinth 14, wherein the labyrinth 14 is configured so that a secondary degassed coolant flow F4 is extracted from the residual coolant flow F3 by flowing of the residual coolant flow F3 through the labyrinth 14;
- wherein the bypass 13 leads to the degassed coolant outlet 20, so that the primary degassed coolant flow F2 flows from the bypass 13 to the degassed coolant outlet 20, without flowing through the labyrinth 14;
- wherein the labyrinth 14 leads to the degassed coolant outlet 20, so that the secondary degassed coolant flow F4 flows from the labyrinth 14 to the degassed coolant outlet 20, without flowing through the bypass 13.

Example 2: The degassing device 10 according to example 1, wherein the degassing tank 11 comprises an outlet compartment 15, bordering with the bypass 13 and with the labyrinth 14 and leading to the degassed coolant outlet 20; the bypass 13 leads to the degassed coolant outlet 20 by leading to the outlet compartment 15; and the labyrinth 14 leads to the degassed coolant outlet 20 by leading to the outlet compartment 15.

Example 3: The degassing device 10 according to examples 1 and 2, wherein the degassing device 10 further comprises at least one centrifugation cavity 16 arranged inside the separator compartment 12, enabling the centrifugation of the engassed coolant flow F1 for extracting the primary degassed coolant flow F2 and the residual coolant flow F3 inside said at least one centrifugation cavity 16.

Example 4: The degassing device 10 according to example 3, wherein the degassing device 10 further comprises at least one inlet port 17, opening outside of the degassing tank 11 and leading to said at least one centrifugation cavity 16, for flowing of the engassed coolant flow F1 from outside of the degassing tank 11 to said at least one centrifugation cavity 16.

Example 5: The degassing device 10 according to example 4, wherein said at least one centrifugation cavity 16 has a geometry of revolution about a central axis Z16.

Example 6: The degassing device 10 according to example 5, wherein the separator compartment 12, the bypass 13, the labyrinth 14 and said at least one centrifugation cavity 16 are crossed by a main plane P11 of the degassing tank 11.

Example 7: The degassing device 10 according to example 6, wherein the central axis Z16 is perpendicular or oblique relative to the main plane P11.

Example 8: The degassing device 10 according to examples 6 or 7, wherein said at least one inlet port 17 is connected to said at least one centrifugation cavity 16 tangentially to a peripheral wall 16A of the centrifugation cavity 16 and orthogonally to the central axis Z16, so that the centrifugation is induced by flowing of the engassed coolant flow F1 from said at least one inlet port 17 to said at least one centrifugation cavity 16.

Example 9: The degassing device 10 according to examples 4 to 8, wherein the degassing device 10 further comprises at least one first outlet port 18 opening inside said at least one centrifugation cavity 16 and leading to the bypass 13, for the primary degassed coolant flow F2 to flow from said at least one centrifugation cavity 16 to the bypass 13; and at least one second outlet port 19 opening inside said at least one centrifugation cavity 16 and leading to the labyrinth 14, for the residual coolant flow F3 to flow from said at least one centrifugation cavity 16 to the labyrinth 14.

Example 10: The degassing device 10 according to example 9, wherein, in said at least one centrifugation cavity 16, said at least one inlet port 17 is arranged between said at least one first outlet port 18 and said at least one second outlet port 19.

Example 11: The degassing device 10 according to examples 1 to 10, wherein:

- the labyrinth 14 includes a series of successive labyrinth compartments 24, including a first labyrinth compartment 24A and a last labyrinth compartment 24H;
- each labyrinth compartment 24, except for the last labyrinth compartment 24H, leads to a single other of the labyrinth compartments 24, so that the residual coolant flow F3 and the secondary degassed coolant flow F4 flow successively through each labyrinth compartment 24, from the first labyrinth compartment 24A to the last labyrinth compartment 24H;
- the separator compartment 12 leads to the first labyrinth compartment 24A, so that the residual coolant flow F3 flows from the separator compartment 12 to the first labyrinth compartment 24A; and
- the last labyrinth compartment 24H leads to the degassed coolant outlet 20 so that the secondary degassed coolant flow F4 flows from the last labyrinth compartment 24H to the degassed coolant outlet 20.

Example 12: The degassing device 10 according to examples 1 to 11, wherein the bypass 13 forms a single non-partitioned compartment of the degassing tank 11.

Example 13: The degassing device 10 according to examples 1 to 12, wherein the bypass 13 is surrounded by the separator compartment 12, the labyrinth 14 and the degassed coolant outlet 20.

Example 14: A road vehicle 1, comprising the degassing device 10 according to examples 1 to 13.

Example 15: The road vehicle 1 of example 14, wherein:

the separator compartment 12, the bypass 13 and the labyrinth 14 are crossed by a main plane P11 of the degassing tank 11, and the main plane is oriented parallel to a ground surface 9 when said road vehicle rests on said ground surface 9.

The terminology used herein is for the purpose of describing particular aspects only and is not intended to be limiting of the disclosure. As used herein, the singular forms "a," "an," and "the" are intended to include the plural forms as well, unless the context clearly indicates otherwise. As used herein, the term "and/or" includes any and all combinations of one or more of the associated listed items. It will be further understood that the terms "comprises," "comprising," "includes," and/or "including" when used herein specify the presence of stated features, integers, actions, steps, operations, elements, and/or components, but do not preclude the presence or addition of one or more other features, integers, actions, steps, operations, elements, components, and/or groups thereof.

It will be understood that, although the terms first, second, etc., may be used herein to describe various elements, these elements should not be limited by these terms. These terms are only used to distinguish one element from another. For example, a first element could be termed a second element, and, similarly, a second element could be termed a first element without departing from the scope of the present disclosure.

Relative terms such as "below" or "above" or "upper" or "lower" or "horizontal" or "vertical" may be used herein to describe a relationship of one element to another element as illustrated in the Figures. It will be understood that these terms and those discussed above are intended to encompass different orientations of the device in addition to the orientation depicted in the Figures. It will be understood that when an element is referred to as being "connected" or "coupled" to another element, it can be directly connected or coupled to the other element, or intervening elements may be present. In contrast, when an element is referred to as being "directly connected" or "directly coupled" to another element, there are no intervening elements present.

Unless otherwise defined, all terms (including technical and scientific terms) used herein have the same meaning as commonly understood by one of ordinary skill in the art to which this disclosure belongs. It will be further understood that terms used herein should be interpreted as having a meaning consistent with their meaning in the context of this specification and the relevant art and will not be interpreted in an idealized or overly formal sense unless expressly so defined herein.

It is to be understood that the present disclosure is not limited to the aspects described above and illustrated in the drawings; rather, the skilled person will recognize that many changes and modifications may be made within the scope of the present disclosure and appended claims. In the drawings and specification, there have been disclosed aspects for purposes of illustration only and not for purposes of limitation, the scope of the disclosure being set forth in the following claims.

What is claimed is:

1. A degassing device, for degassing an engassed coolant flow, the degassing device comprising a degassing tank comprising:

a separator compartment, configured for extracting a primary degassed coolant flow and a residual coolant flow from the engassed coolant flow by a centrifugation of the engassed coolant flow inside the separator compartment;

a degassed coolant outlet;

a bypass, bordering with the separator compartment, wherein the separator compartment leads to the bypass so that the primary degassed coolant flow flows from the separator compartment to the bypass; and a labyrinth, bordering with the separator compartment, wherein the separator compartment leads to the labyrinth so that the residual coolant flow flows from the separator compartment to the labyrinth, wherein the labyrinth is configured so that a secondary degassed coolant flow is extracted from the residual coolant flow by flowing of the residual coolant flow through the labyrinth;

wherein the bypass leads to the degassed coolant outlet, so that the primary degassed coolant flow flows from the bypass to the degassed coolant outlet, without flowing through the labyrinth; and wherein the labyrinth leads to the degassed coolant outlet, so that the secondary degassed coolant flow flows from the labyrinth to the degassed coolant outlet, without flowing through the bypass.

2. The degassing device of claim 1, wherein:

the degassing tank comprises an outlet compartment, bordering with the bypass and with the labyrinth and leading to the degassed coolant outlet;

the bypass leads to the degassed coolant outlet by leading to the outlet compartment; and the labyrinth leads to the degassed coolant outlet by leading to the outlet compartment.

3. The degassing device of claim 1, wherein the degassing device further comprises at least one centrifugation cavity arranged inside the separator compartment, enabling the centrifugation of the engassed coolant flow for extracting the primary degassed coolant flow and the residual coolant flow inside the at least one centrifugation cavity.

4. The degassing device of claim 3, wherein the degassing device further comprises at least one inlet port, opening outside of the degassing tank and leading to the at least one centrifugation cavity, for flowing of the engassed coolant flow from outside of the degassing tank to the at least one centrifugation cavity.

5. The degassing device of claim 4, wherein the at least one centrifugation cavity has a geometry of revolution about a central axis.

6. The degassing device of claim 5, wherein the separator compartment, the bypass, the labyrinth and the at least one centrifugation cavity are crossed by a main plane of the degassing tank.

7. The degassing device of claim 6, wherein the central axis is perpendicular or oblique relative to the main plane.

8. The degassing device of claim 6, wherein the at least one inlet port is connected to the at least one centrifugation cavity tangentially to a peripheral wall of the centrifugation cavity and orthogonally to the central axis, so that the centrifugation is induced by flowing of the engassed coolant flow from the at least one inlet port to the at least one centrifugation cavity.

9. The degassing device of claim 4, wherein the degassing device further comprises:

at least one first outlet port opening inside the at least one centrifugation cavity and leading to the bypass, for the primary degassed coolant flow to flow from the at least one centrifugation cavity to the bypass; and at least one second outlet port opening inside the at least one centrifugation cavity and leading to the labyrinth, for the residual coolant flow to flow from the at least one centrifugation cavity to the labyrinth.

10. The degassing device of claim 9, wherein, in the at least one centrifugation cavity, the at least one inlet port is arranged between the at least one first outlet port and the at least one second outlet port.

11. The degassing device of claim 1, wherein:

the labyrinth includes a series of successive labyrinth compartments, including a first labyrinth compartment and a last labyrinth compartment;

each labyrinth compartment, except for the last labyrinth compartment, leads to a single other of the labyrinth compartments, so that the residual coolant flow and the secondary degassed coolant flow flow successively through each labyrinth compartment, from the first labyrinth compartment to the last labyrinth compartment;

the separator compartment leads to the first labyrinth compartment, so that the residual coolant flow flows from the separator compartment to the first labyrinth compartment; and the last labyrinth compartment leads to the degassed coolant outlet so that the secondary degassed coolant flow flows from the last labyrinth compartment to the degassed coolant outlet.

12. The degassing device of claim 1, wherein the bypass forms a single non-partitioned compartment of the degassing tank.

13. The degassing device of claim 1, wherein the bypass is surrounded by the separator compartment, the labyrinth and the degassed coolant outlet.

14. A road vehicle, comprising the degassing device of claim 1.

15. The road vehicle of claim 14, wherein:

the separator compartment, the bypass and the labyrinth are crossed by a main plane of the degassing tank; and the main plane is oriented parallel to a ground surface when the road vehicle rests on the ground surface.

* * * * *